US006490811B1

(12) United States Patent
Wahlström

(10) Patent No.: US 6,490,811 B1
(45) Date of Patent: Dec. 10, 2002

(54) APPARATUS FOR CONTROLLING SHRINKAGE IN A FIBER WEB DURING A DRYING PROCESS AND ASSOCIATED METHOD

(75) Inventor: Torbjörn Wahlström, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 65 days.

(21) Appl. No.: 09/721,129

(22) Filed: Nov. 22, 2000

Related U.S. Application Data

(60) Provisional application No. 60/172,470, filed on Dec. 17, 1999.

(30) Foreign Application Priority Data

Nov. 26, 1999 (SE) ..... 9904332

(51) Int. Cl.[7] ..... F26B 13/06

(52) U.S. Cl. ..... 34/114; 34/116; 34/648; 34/646; 34/306; 34/445; 34/94

(58) Field of Search ..... 34/306, 443, 444, 34/445, 453, 454, 94, 116, 114, 117, 664, 648, 645, 646, 120

(56) References Cited

U.S. PATENT DOCUMENTS 3,643,338 A * 2/1972 Fair ..... 34/6
4,680,873 A 7/1987 Fellers et al.
4,967,489 A * 11/1990 Autio ..... 34/114
5,553,392 A 9/1996 Hanaya
5,647,141 A 7/1997 Hanaya
5,737,848 A 4/1998 Chau-Huu et al.
5,770,015 A * 6/1998 Grossmann et al. ..... 162/359.1
5,787,603 A 8/1998 Steiner et al.
5,864,965 A 2/1999 Hansson et al.
5,921,000 A 7/1999 Wedel et al.
5,926,971 A * 7/1999 ChauHuu et al. ..... 34/117
5,933,979 A * 8/1999 Wedel ..... 34/446
5,966,834 A * 10/1999 Steiner et al. ..... 64/116

FOREIGN PATENT DOCUMENTS

DE 1111 811 7/1961

* cited by examiner

*Primary Examiner*—Ira S. Lazarus
*Assistant Examiner*—K. B. Rinehart
(74) *Attorney, Agent, or Firm*—Alston & Bird LLP

(57) ABSTRACT

A drying section for drying and controlling shrinkage of a moist fiber web in a paper making machine is provided, the web having a predetermined width and opposed transverse ends. Such a drying section comprises a plurality of drying section members configured to receive and forward the web in a machine direction. Each drying section member has opposed ends in a transverse direction. The drying section members further comprise a first drying section member and a second drying section member, with the second drying section member being separated from the first drying section member so as to define an intermediate zone therebetween. The drying section further comprises a primary belt set having a belt member wrapping about each of the opposed ends of each of the drying section members. Each belt member is configured in an endless loop and has a width less than half of the width of the web. The drying section also comprises a first web-contacting element opposing the primary belt set, at least substantially through the intermediate zone, such that the web is disposed therebetween. The first web-contacting element cooperates with the primary belt set so as to at least partially constrain the web about the opposed transverse ends thereof to thereby control at least transverse shrinkage of the web. The invention is suitable for, for example, printing paper, paperboard or liner, but can also be utilized for other paper grades. An associated method and fiber web produced according to the method are also provided.

34 Claims, 11 Drawing Sheets

APPARATUS FOR CONTROLLING SHRINKAGE IN A FIBER WEB DURING A DRYING PROCESS AND ASSOCIATED METHOD

CROSS-REFERENCE TO RELATED APPLICATIONS

This application claims the benefit of U.S. Provisional Patent Application No. 60/172,470 filed on Dec. 17, 1999.

FIELD OF THE INVENTION

The present invention relates to paper making machines and, more particularly, to an apparatus for controlling shrinkage of a fiber web, such as a paper or paperboard web, during a drying process, an associated method, and a fiber web produced according to the method.

BACKGROUND OF THE INVENTION

There has been an ongoing need to control the shrinkage of a paper web in the machine direction as well as perpendicularly to the machine direction (here referred to as the transverse direction) which occurs during the drying of the paper web. The magnitude of the shrinkage is determined by, for example, the properties of the papermaking pulp in question and the design of the drying section in question.

It is important for the process steps following the drying process, and for the final paper product, that the paper web shrinks uniformly, if at all, over the machine width. An uneven shrinkage profile gives the paper web undesirable physical properties, which may vary over the width of the web.

Uneven shrinkage of a paper web during drying can cause, for example, a paper curl, i.e. that a sheet of paper from the dried paper web will tend to roll itself up to a cylindrical form about an imagined axis. A reduced shrinkage promotes a final sheet of paper having a higher stiffness, no curl, and a smoother surface, wherein such characteristics are desirable for most paper and paperboard grades. In instances where the shrinkage is too little, the paper may, however, become too stiff for its intended purpose. For paper grades where high stretch at break, high tensile energy absorption, or low module of elasticity are desirable, it may be favorable to permit controlled shrinkage of the web during drying. Examples of such paper grades include kraft sack paper and uncreped soft paper.

The shrinkage in both the machine direction (MD) and the transverse direction (TD) influences the properties of the final paper. With modern machines, shrinkage in the machine direction can be controlled relatively well, e.g. by means of accurate control of the roll speeds and web tension through the drying section. However, it is typically more difficult to control shrinkage in the transverse direction (TD).

A significant contributor to web shrinkage is free draw between the drying cylinders in a drying section. Accordingly, a number of different arrangements have been developed which strive to restrain the paper web throughout the entire drying section in different ways, i.e. also at the free draws between the drying cylinders.

U.S. Pat. No. 5,864,965, for instance, discloses a solution which comprises holding the web edges to a drying fabric with suction boxes positioned between the drying cylinders in a drying section in order to counteract the shrinkage of the web in the transverse direction. According to U.S. Pat. No. 5,864,965, a partial vacuum is maintained along the edge portions of the web across essentially the entire free draw, wherein the vacuum is applied from the side of the drying fabric, which is turned away from the web. As such, the web will be steadily sucked to the drying fabric with forces that are greater than the counteracting forces acting in the transverse direction, thereby counteracting web shrinkage. The partial vacuum is stated as being set within the range 0.1 to 0.8 bar, preferably between 0.2 to 0.5 bar.

Furthermore, U.S. Pat. No. 4,680,873 describes an arrangement and a method of controlling or adjusting shrinkage and/or stretching of a paper web transverse to the transport direction in a drying section of a paper making machine, in which the drying section has the shape of a cylinder dryer and/or a fan dryer. At a point in the drying process when the paper web has a dry solids content of at most 75%, the paper is subjected to outward forces, which are forced to act at the edge portions of the web. The forces are brought to act upon adjacent, parallel edge portions of the paper web and are directed away from each other. The magnitude of these forces are stated to be chosen so that they are at the most 50% lower than the shrinkage forces which momentarily occur on the paper web at the specified dry solids content.

U.S Pat. Nos. 5,553,392 and 5,647,141 describe an apparatus and a method, respectively, for drying a wet sheet material, such as a paper web. The apparatus is equipped with an appropriate number of drying cylinders, which operate in cooperation with a plurality of steam openings provided adjacent to the drying cylinders. The apparatus incorporates one or more gas permeable material belts arranged to cooperate with the drying cylinders for transporting the sheet material. The material belt or belts is/are then looped about the different drying cylinders for urging the sheet material against their outer circumferential surfaces and holding the sheet material during the drying operation. It is stated that the purposes of what is described in U.S. Pat. No. 5,553,392, among other things, are to be able to limit the shrinkage of the paper web, and to achieve a high speed for removal of moisture, which gives an efficient and energy saving drying process.

U.S Pat. No. 5,737,848 describes a drying section for a running paper web with consecutive drying groups, each having drying cylinders. Felts or wires support the running paper web and rest against the drying cylinders. Guide rolls guide the web and the felts/wires. The guide rolls are arranged so that the running web is guided in a meandering manner in the transfer region between two consecutive drying cylinders, each associated with different felts or wires. In U.S. Pat. No. 5,737,848 it is stated, among other things, that the guide rolls are positioned in such a manner and that the felts are supported by the guide rolls in such a manner, that the paper web can be supported substantially continuously through the transfer region. It is stated that the purpose of the arrangement described in U.S. Pat. No. 5,737,848, among other things, is to reduce vibrations and to keep undesired shrinkage of the paper web to a minimum.

Further, U.S. Pat. No. 5,787,603 describes a drying section in a machine for production of a paper web, wherein the drying section incorporates a plurality of heatable drying cylinders. The drying section incorporates a support belt, which by use of guide rolls, encloses a portion of the circumference of each of the drying cylinders against which the paper web is urged. According to U.S. Pat. No. 5,787,603, the drying section incorporates pressing devices which, via the support belt, press the paper web against the drying cylinders. The pressing devices can include press rolls which are urged against the support belt, e.g. by means of springs.

It is stated that one of the purposes of the arrangement disclosed in U.S. Pat. No. 5,787,603 is to be able to reduce the tension in the support belt without impairing the drying contact between the drying cylinders and the paper web.

U.S. Pat. No. 5,921,000 describes a drying section which utilizes top-felted and bottom-felted drying sections, each of which incorporates a single steam-heated drying cylinder. The paper web to be dried is transferred between the drying cylinders by means of a vacuum roll transfer without any open draw. The wrap of the machine fabric over the drying cylinders is over 270 degrees, which is considered to give a high drying capacity per drying cylinder. As each drying cylinder is followed by another drying cylinder that dries the opposite side of the paper web, it is stated that it is possible to secure the uniformity of the drying. Each drying cylinder might have its own stretching means and guide means for the machine fabric. It is stated that the paper web can be restrained during about 96% of the period of its passage through the drying section.

However, the earlier known arrangements for controlling the shrinkage or other dimensional change of a paper or paperboard web during the drying operation have certain shortcomings. For example, earlier systems having belt-like members, extending through the drying section for exerting forces upon the edges of the web, may not be capable of delivering a sufficient, continuous holding force for holding the web rigidly through the entire drying section to thereby prevent or control the shrinkage of the web in transverse direction. In addition, in earlier known arrangements where the web is supported or to some extent is firmly secured by aid of suction rolls, machine fabrics, guide rolls, sometimes in cooperation with drying cylinders, may also be incapable of ensuring a sufficiently large, continuous holding force throughout the entire drying section. Further, such types of earlier known arrangements are not capable of controlling the width of the web.

In the field of transverse stretching of plastic films and foils, some machine configurations may include an arrangement of pressure rolls, which directly or via V-belts, hold the edges of the films or foils therebetween in draws between the stretching rolls. Such an arrangement is described in DE-B 11 11 811. An arrangement of the type described in DE-B 11 11 811, applied to paper or paperboard production, however, would not be capable of maintaining a sufficiently large, continuous holding force on a running, moist paper or paperboard web during passage through a drying section.

Thus, there exists a need for a drying section in a paper making machine capable of controlling shrinkage in a fiber web during the drying process.

SUMMARY OF THE INVENTION

The above and other needs are met by the present invention which, in one embodiment, provides a drying section for drying and controlling shrinkage of a moist fiber web, the web having a predetermined width and opposed transverse ends, in a paper making machine. Such a drying section comprises a plurality of drying section members configured to receive and forward the web in a machine direction. Each drying section member has opposed ends in a transverse direction. The drying section members further comprise a first drying section member and a second drying section member, with the second drying section member being separated from the first drying section member so as to define an intermediate zone therebetween. The drying section further comprises a primary belt set having a belt member wrapping about each of the opposed ends of each of the drying section members. Each belt member is configured in an endless loop and has a width less than half of the width of the web. The drying section also comprises a first web-contacting element opposing the primary belt set, at least substantially through the intermediate zone, such that the web is disposed therebetween. The first web-contacting element cooperates with the primary belt set so as to at least partially constrain the web about the opposed transverse ends thereof to thereby control at least transverse shrinkage of the web.

Another advantageous aspect of the present invention comprises a method of drying and controlling shrinkage of a moist fiber web, wherein the web has a predetermined width and opposed transverse ends, in a drying section of a paper making machine. First, the web is forwarded about a plurality of drying section members configured to receive and forward the web in a machine direction. Each drying section member has opposed ends in a transverse direction. The drying section members further comprise a first drying section member and a second drying section member, with the second drying section member being separated from the first drying section member so as to define an intermediate zone therebetween. Next, the web is at least partially constrained in at least the transverse direction, and at least substantially through the intermediate zone, with a first belt set disposed opposite to the web from a web-contacting element, wherein both the first belt set and the web-contacting element operably engaging the web. The first belt set comprises a belt member wrapping about each of the opposed ends of each of the drying section members, wherein each belt member is configured in an endless loop and has a width less than half of the width of the web. The first belt set cooperates with the web-contacting element to at least partially constrain the web about the opposed transverse ends thereof so as to control shrinkage of the web.

In addition, a fiber web produced according to a method such as described herein would exhibit increased stiffness due to the shrinkage control experienced during the drying process. Consequently, for example, less papermaking fibers may be required in order to produce the paper grades having the same stiffness than in corresponding paper grades produced according to a process where shrinkage is not controlled.

Thus, embodiments of a drying section in a paper making machine according to the present invention are capable of controlling shrinkage in a fiber web during the drying process and producing an advantageous product thereby.

BRIEF DESCRIPTION OF THE DRAWINGS

Some of the advantages of the present invention having been stated, others will appear as the description proceeds, when considered in conjunction with the accompanying drawings, which are not necessarily drawn to scale, in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
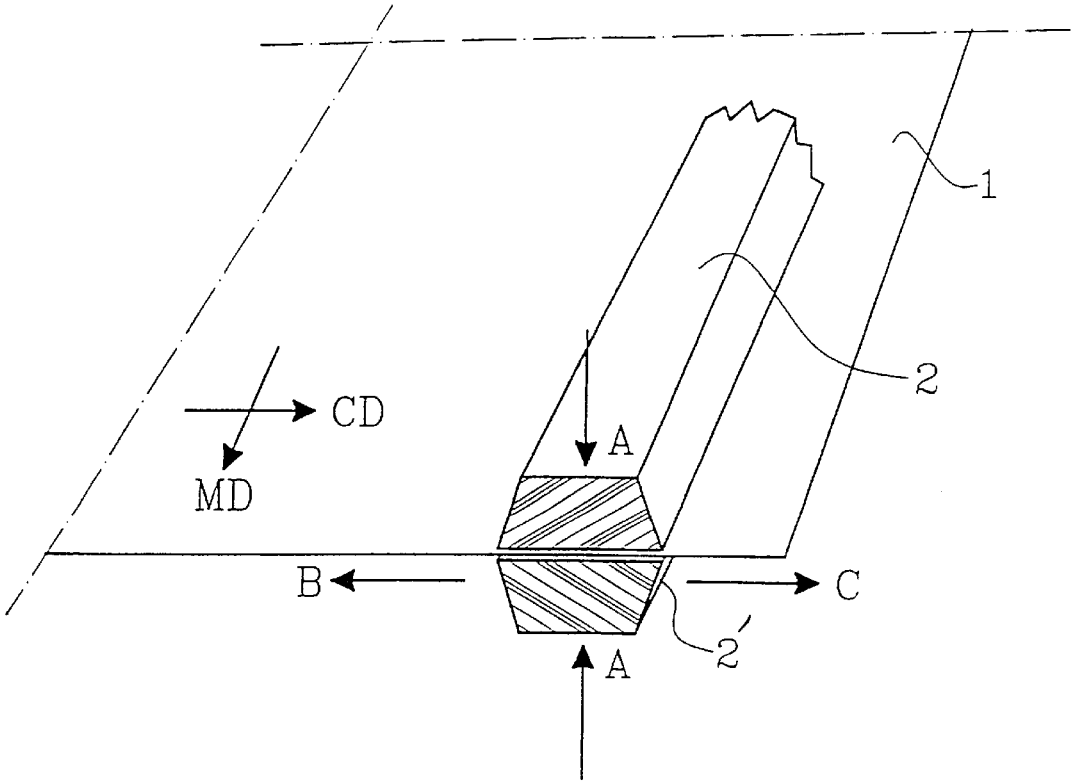
FIG. 1 is a schematic diagram of the resulting forces when one edge of a paper or paperboard web is held between belt members in a drying section according to prior art apparatuses and methods.

FIG. 1 illustrates conditions which may occur when securing the edge of a paper or paperboard web running through a drying section in order to eliminate or control shrinkage of the web in transverse direction according to one embodiment of the present invention. The web 1 runs through the drying section in the machine direction MD. In the machine direction MD of the drying section are arranged opposing belt members 2, 2', between which the edge of the web 1 runs in the machine direction MD and is secured with a securing force A. During the drying operation, the web 1 typically tends to shrink in transverse direction TD in the direction of the arrow B, which illustrates a shrinkage force. In order to prevent shrinkage in the transverse direction TD, an opposing force C is required to be of the same magnitude as the force B. In order to achieve a force C of the same magnitude as force B, it is necessary that a sufficiently large holding/securing force A act upon the belt members 2, 2'. In order to be effective, the securing force A must be uniform throughout the entire drying section. This has been difficult to achieve with earlier known arrangements where the edges of the paper or paperboard web are firmly secured between belt members.

Different embodiments of a method according to the invention for controlling at least the width of a running, moist paper or paperboard web during the drying process, are now described with reference to the accompanying FIGS. 2–12. It is advantageous to practice the invention during a drying process for paper or paperboard webs intended for printing paper, board or liner. However, it will be understood by one skilled in the art that the invention can also be utilized at production of other paper grades for which it is critical to be able to control at least the width of the web during the drying operation.

In a method according to embodiments of the invention, at least the width of a running, moist paper or paperboard web 101; 201; 301; 401; 501; 601; 701 is controlled, while during the drying process in a drying section 100; 200; 300; 400; 500; 600; 700, wherein the drying section includes at least one body 103, 103', 103"; 203, 203', 203"; 303, 303'; 403, 403'; 503, 503', 503"; 603, 603'; 703, 703' capable of emitting heat that is transferred to the web 101; 201; 301; 401; 501; 601; 701 so as to evaporate residual water therein.

The drying section 100; 200; 300; 400; 500; 600; 700 thereby has a machine direction MD and a transverse direction TD, perpendicular to the machine direction, and, in the transverse direction TD, a tender side and a drive side. At each of these sides, at least one belt member 102, 102', 102"; 202, 202', 202"; 302, 302'; 402, 402'; 502, 502'; 602, 602'; 702, 702' is arranged in an endless loop.

The belt members 102, 102', 102"; 202, 202', 202"; 302, 302'; 402, 402'; 502, 502'; 602, 602'; 702, 702' each have a belt width 105' which is less than half the width of the web 101, wherein the belt members 102, 102', 102"; 202, 202', 202"; 302, 302'; 402, 402'; 502, 502'; 602, 602'; 702, 702' are arranged through the drying section so as to secure opposed side edges of the web 101; 201; 301; 401; 501; 601; 701 at least through an intermediate zone 106, 106'; 206, 206'; 306; 406; 506, 506'; 606; 706 between two drying section members which are spaced apart in the machine direction MD.

Figure 4:
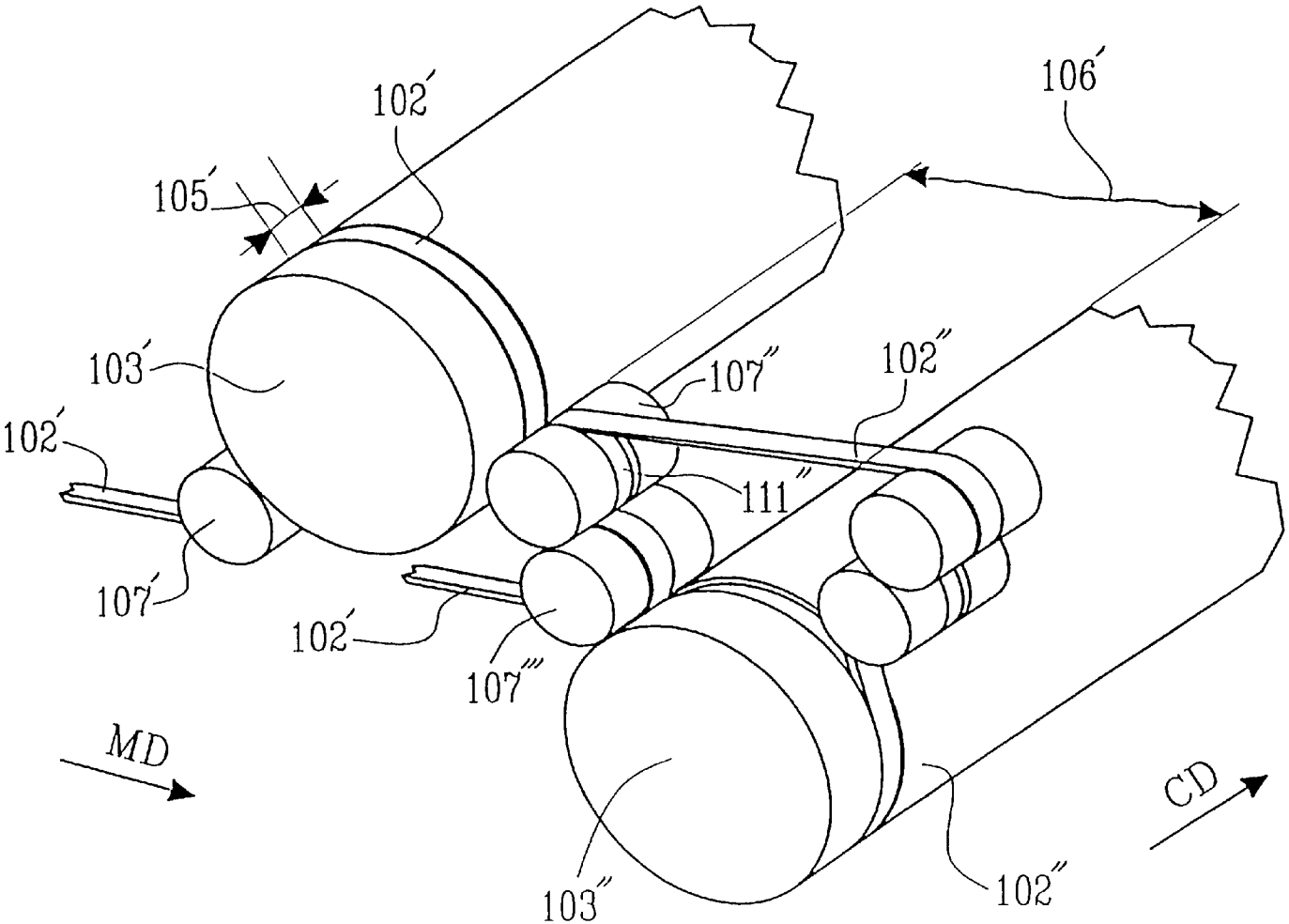
FIG. 4 is a schematic perspective view of the drying section illustrated in FIGS. 2 and 3, showing the extension of the intermediate zone in the machine direction.
Figure 12:
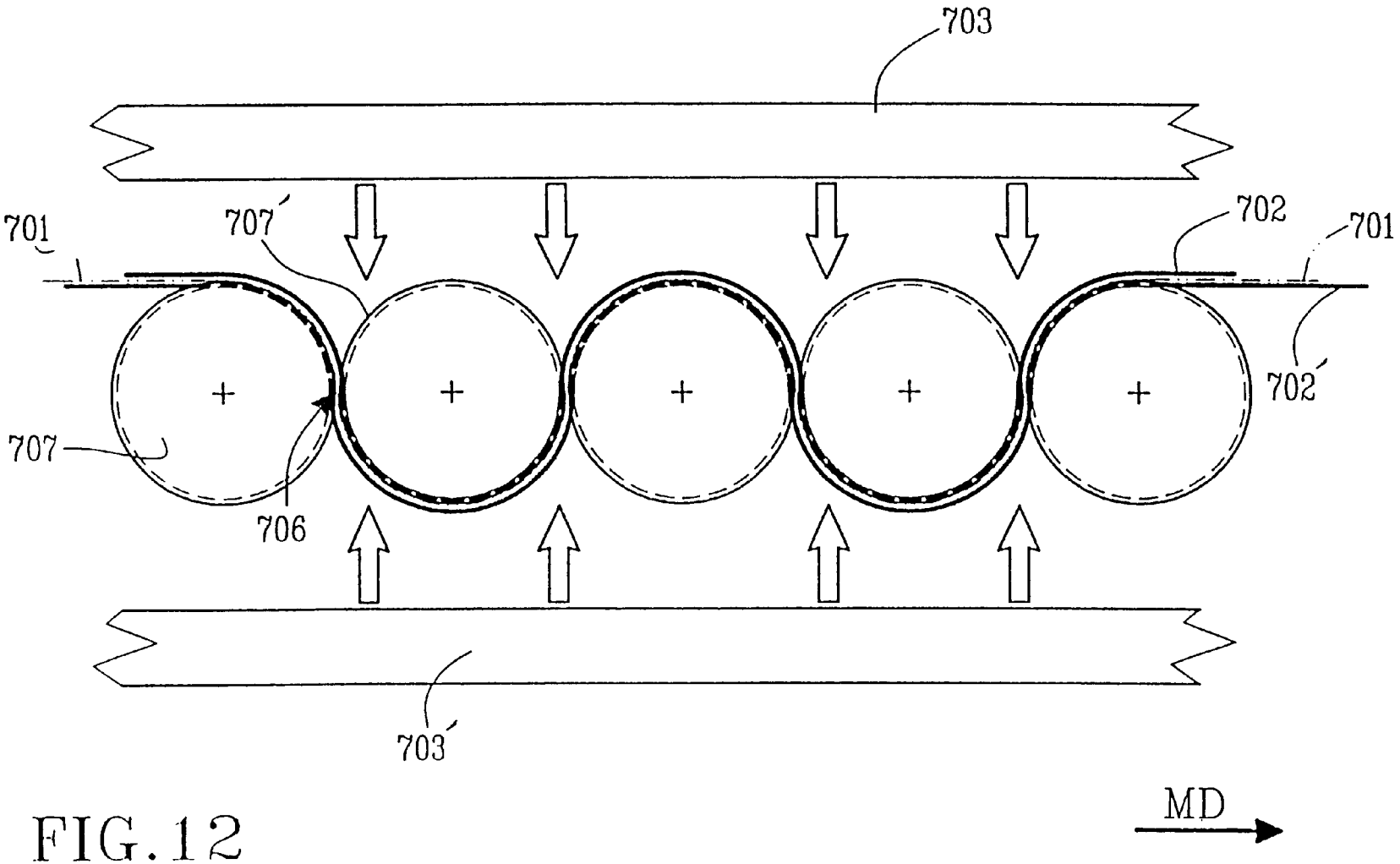
FIG. 12 is a schematic side view of a linear type drying section in accordance with a further alternative embodiment of the invention.

The expression "intermediate zone" used herein refers, as can be seen by the arrow 106' in FIG. 4, in principle to the free draw present in corresponding prior art drying sections. The beginning and the end of the intermediate zone, i.e. the points where the belt members begin and cease, respectively, to secure of the web therethrough, are typically defined by drying section members. Thus, the intermediate zone may extend between the external circumferences of the two drying cylinders in a drying section but also along the entire drying section, as illustrated in FIG. 12.

In a method according to embodiments of the invention, the belt members 102, 102', 102"; 202, 202', 202"; 302, 302'; 402, 402'; 502, 502'; 602, 602'; 702, 702' are in direct or indirect contact with at least one preferably cylindrical counter element 107, 107', 107", 107'"; 207, 207', 207", 207'"; 307, 307', 307"; 407; 507, 507', 507", 507'"; 607; 707, 707' while accompanying the web while the web is secured therebetween through the intermediate zone 106, 106'; 206, 206'; 306; 406; 506, 506'; 606; 706. The width of the web is thereby controlled in that the edges of the web 101; 201; 301; 401; 501; 601; 701 are at least substantially continuously secured in their intended transverse positions during drying of the web. Accordingly, it will be understood by one skilled in the art that the number of intermediate zones could be one or several, depending on the configuration of the drying section.

In one embodiment of a method according to the invention, a desired width of the web is maintained in the intermediate zone 106, 106'; 206, 206'; 306; 406; 506, 506'; 606; 706 by the belt members and the counter elements accompanying the web and opposing the shrinkage forces generated during the drying operation.

In another advantageous embodiment of a method according to the invention, in the intermediate zone 106, 106'; 206, 206'; 306; 406; 506, 506'; 606; 706, the width of the web may be gradually reduced by the belt members and the counter elements being configured to allow web shrinkage, though to a lesser extent than if the edges of the web were not constrained.

Figure 3:
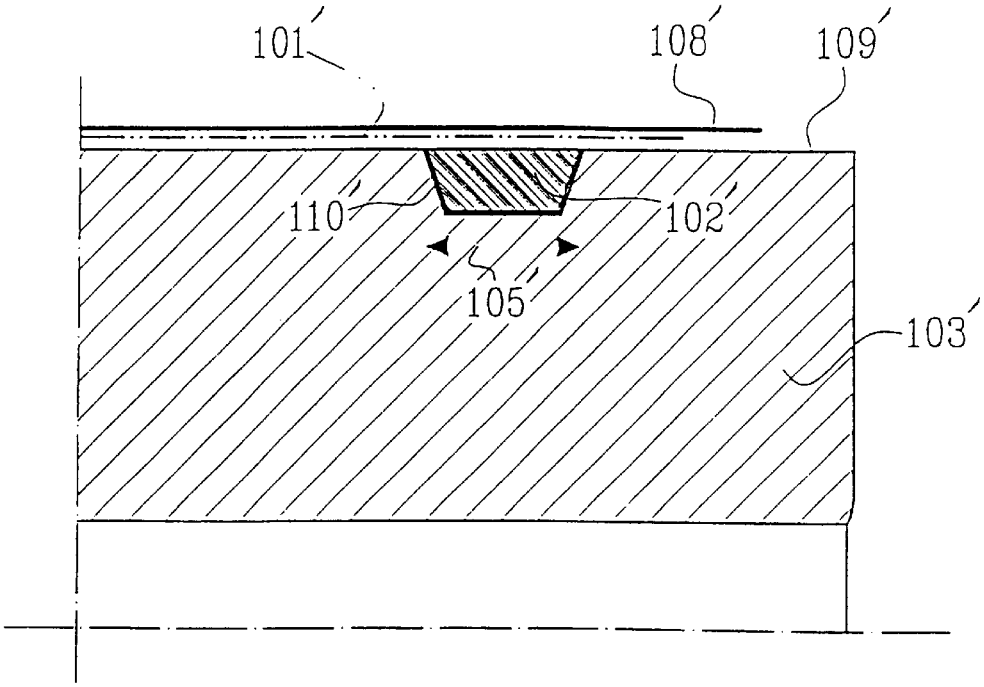
FIG. 3 is a schematic cross-sectional view in the machine direction corresponding to a portion of a roll forming part of the drying section shown in FIG. 2.

In still a further advantageous embodiment of a method according to the invention, the web width in the intermediate zone 106, 106'; 206, 206'; 306; 406; 506, 506'; 606; 706 may gradually be increased by the belt members and the counter elements accompanying the web. For instance, expansion of the width of the web may be achieved by providing grooves 110', similar to what is shown in FIG. 3, at each end of the drying cylinders and in the counter elements, and at an increased distance from each other for successive drying cylinders and in the counter elements through the drying section. In this manner, the belt members will gradually diverge from each other during passage through the drying section and will thereby generate forces on the web directed outwards in the transverse direction TD. In other embodiments of a method according to the invention, the belt members, during passage through the drying section, may be alternatingly allowed to diverge from each other and then converge towards each other, or vice versa. Still other embodiments may combine alternating convergence/divergence or convergence/divergence with belt members running in parallel with the machine direction MD in certain areas of the drying section.

In some embodiment of a method according to the invention, the web may be stretched, or at least prevented from shrinking freely in the machine direction MD. This can be achieved by adjustment of the rotational speeds of the different drying cylinders and/or the line speeds of the drying units. Such a method, combined with the control of the width of the web in the transverse direction, thus gives significant control over the dimensional changes of the web in the machine direction MD as well as in the transverse direction TD, and it therefore provides many possibilities of influencing or improving the physical properties of the final paper or the finished paperboard.

A plurality of different embodiments of a drying section according to the invention, capable of implementing the associated methods according to embodiments of the invention, are now described with reference to the accompanying FIGS. 2–12.

According to embodiments of the invention, the drying section includes at least one drying unit 100; 200; 300; 400; 500; 600; 700 having at least one drying section member 103, 103', 103"; 203, 203', 203"; 303, 303'; 403, 403'; 503, 503', 503"; 603, 603'; 703, 703' capable of emitting heat that can be transferred to the web 101; 201; 301; 401; 501; 601; 701 so as to evaporate residual water therein. The expression "drying unit" shall be understood as, for example, a drying group with a plurality of drying cylinders or as, for instance, a blowing-on unit with a plurality of transverse blowing boxes (i.e. heat emitting bodies which emit hot air). As will be known to one skilled in the art, a drying section of a paper or paperboard making machine usually includes a plurality of such drying units. Drying units of different types and with different methods of operation can also form a drying section. Within the scope of the invention, other drying sections may also be implemented, which may include, for instance, cylinder drying units or basically linear drying units (e.g. of the Valmet OptiDry type), or combinations thereof.

Further, a drying unit within a drying section defines a machine direction MD and a transverse direction TD, perpendicular to the machine direction, and, in the transverse direction, a tender side and a drive side. At each of these sides, at least one belt member 102, 102', 102"; 202, 202', 202"; 302, 302';402, 402'; 502, 502'; 602, 602'; 702, 702' is arranged in an endless loop. The belt members have a belt width 105'which is less than half the width of the web 101. During the drying process, the belt members are arranged so as to help to firmly secure opposite side edges of the web 106, 106'; 206, 206'; 306; 406; 506, 506'; 606; 706, at least through the intermediate zone 106, 106'; 206, 206'; 306; 406; 506, 506'; 606; 706 in the machine direction MD.

In such a drying section according to embodiments of the invention, there are provided supporting counter elements 107,107'"; 207, 207'"; 307'; 407, 407'; 507,507'"; 607, 607'; 707 arranged and configured such that the belt members 102, 102', 102"; 202, 202', 202"; 302, 302'; 402, 402'; 502, 502'; 602, 602'; 702, 702'are urged, with direct or indirect contact against at least one curved, preferably cylindrical main counter element 107', 107"; 207', 207"; 307, 307"; 407; 507', 507'"; 607; 707' accompanying the web. The web is thereby continuously secured between the belt members through the entire intermediate zone 106, 106'; 206, 206'; 306; 406; 506, 506'; 606; 706 so as to control the width of the web, wherein the edges of the web 101; 201; 301; 401; 501; 601; 701 are at least substantially continuously secured so as to at least maintain the transverse width thereof during the drying of the web. This will enable the securing force A, discussed in connection with FIG. 1, acting on the fibrous web from the belt members, to be kept continuous and of sufficient magnitude when the fibrous web subsequently runs through the intermediate zone between the outer circumferences of the drying cylinders in a cylinder drying section. The reason that the securing force is higher in the drying section according to embodiments of the invention, as opposed to earlier known solutions, is that the support counter elements and the main counter elements permit that a pressure p, which the belt members exert on the fibrous web in the intermediate zone can be increased and held at a constant and sufficient magnitude. The pressure $p=T/R$, where T is the tension in the belt member and R is the radius of the counter element.

In one embodiment of the invention, the belt members, the support counter elements and the main counter elements are arranged to maintain a desired width of the web in the intermediate zone 106, 106'; 206, 206'; 306; 406; 506, 506'; 606; 706, regardless of the shrinkage forces arising during drying.

In another embodiment of a drying section according to the invention, the belt members, the support counter elements and the main counter elements are arranged to gradually reduce the width of the web in the intermediate zone 106, 106'; 206, 206'; 306; 406; 506, 506'; 606; 706 by permitting at least some web shrinkage, though to a lesser extent than if the web were not constrained.

In a further embodiment of a drying section according to the invention, the belt members, the support counter elements and the main counter elements may be arranged to gradually increase the width of the web in the intermediate zone 106, 106'; 206, 206'; 306; 406; 506, 506'; 606; 706 by, for example, stretching. Further, in one embodiment of a drying section according to the invention, the drying unit or drying units 100; 200; 300; 400; 500; 600; 700 are arranged to stretch the web, or at least to prevent it from shrinking freely in the machine direction MD, during the drying.

In an alternative embodiment of a drying section according to the invention, as illustrated in FIG. 12, the drying unit 700 (or the drying units) comprises a linear dryer for drying a web, wherein the heat-emitting body or bodies include at least one blowing-on element 703, 703' for blowing hot air against the web. The heat-emitting body or bodies further extend over the width of the web 701 and spaced at a substantially constant distance from the web. Accordingly, it will be understood by one skilled in the art that the heat emitting bodies may comprise appropriate members for drying the web such as, for example, by IR drying, induction drying or other types of drying.

In still another embodiment of a drying section according to the invention, as illustrated in FIGS. 2, 5–8, and 11, the drying unit 100; 200; 300; 400; 600'(or the drying units) is a multicylinder drying group with at least two heat-emitting bodies comprising drying cylinders 103, 103', 103"; 203, 203', 203"; 303, 303'; 403, 403'extending over the width of the web 101; 201; 301; 401, with each having a circumference 104, 104', 104" and spaces between the circumferences, which form at least one of said intermediate zones 106, 106'; 206, 206'; 306, 406. The web rests against the drying cylinders during a part of the drying process, and at least one machine fabric, such as a drying fabric 108, 108'; 208, 208'; 308; 408; 608 runs about at least a portion of the circumference 104, 104', 104" of at least a first drying cylinder 103; 203; 303; 403 of the drying cylinders and is arranged to secure the fibrous web 101; 201; 301; 401 against at least a portion of the circumference of the first drying cylinder during the drying operation.

In still another advantageous embodiment of a drying section according to the invention, as illustrated in FIGS. 2 and 4–6, the belt members may include a first belt member 102; 202; 302 arranged in a first endless loop, and a second belt member 102'; 202'; 302' arranged in a second endless loop, wherein the first and the second loops accompany each other only in the intermediate zone 106; 206; 306.

Figure 7:
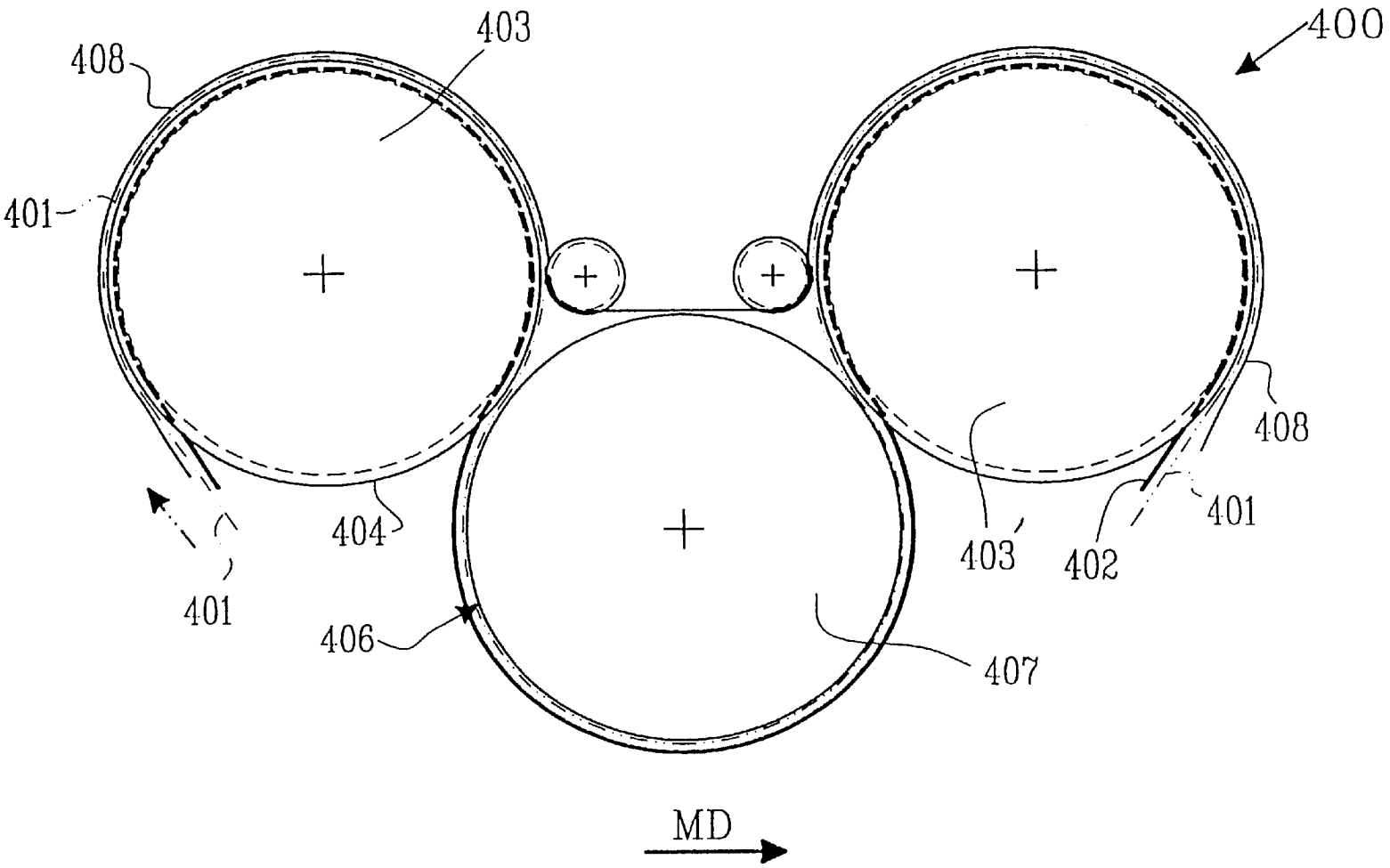
FIG. 7 is a schematic side view of a single-tier drying section in accordance with an alternative embodiment of the invention.
Figure 8:
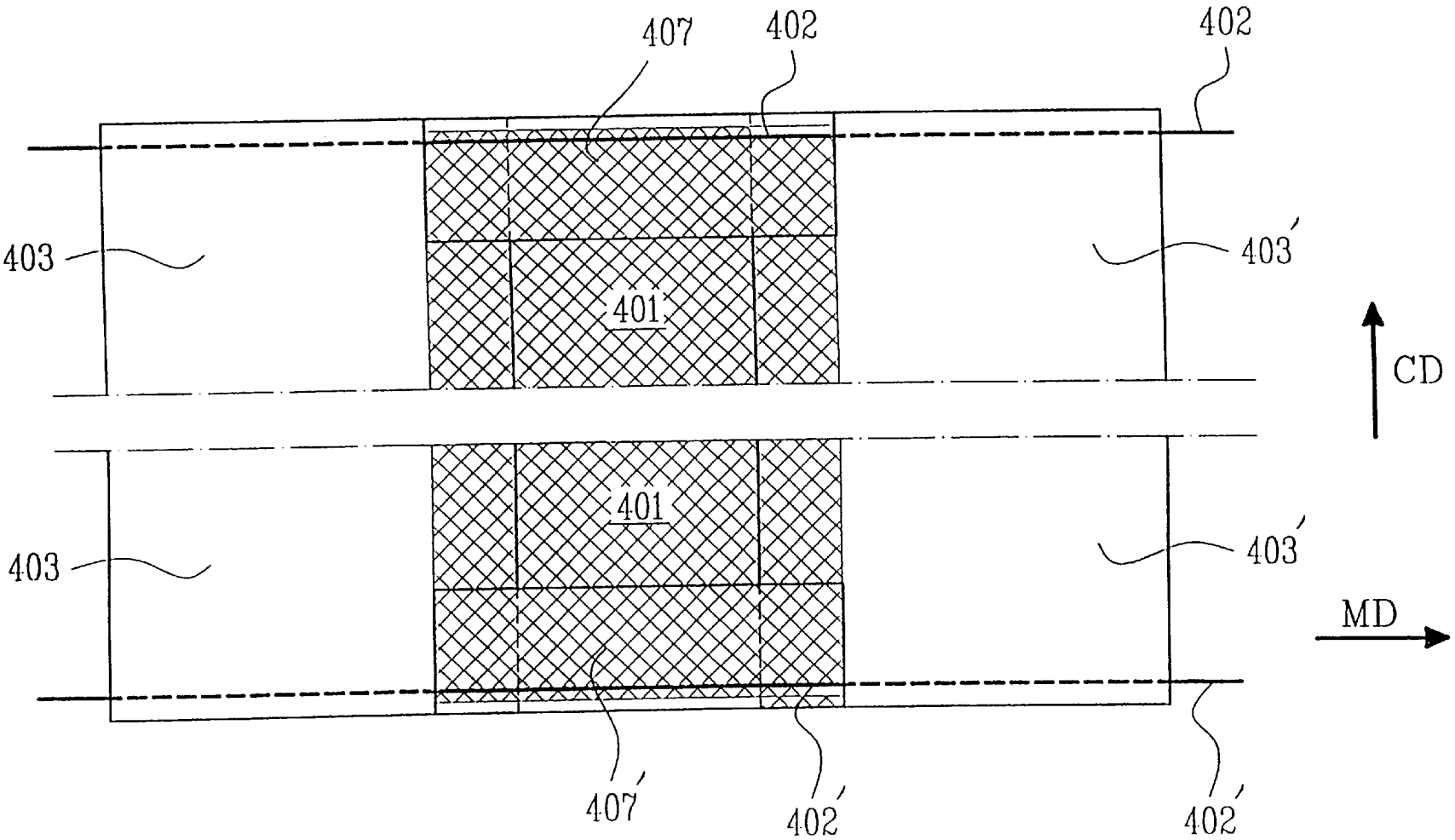
FIG. 8 is a schematic view from below the drying section arrangement shown in FIG. 7.

In another advantageous embodiment of a drying section according to the invention, as illustrated in FIGS. 7 and 8, the belt members include a third belt member 402 arranged in a third endless loop and at least one machine fabric 408, such as a drying fabric, is arranged in a fourth endless loop. In such an embodiment, the third and fourth loops accompany each other over the drying cylinders 403, 403', wherein the intermediate zone 406 is formed about at least one of the support members 407.

Figure 2:
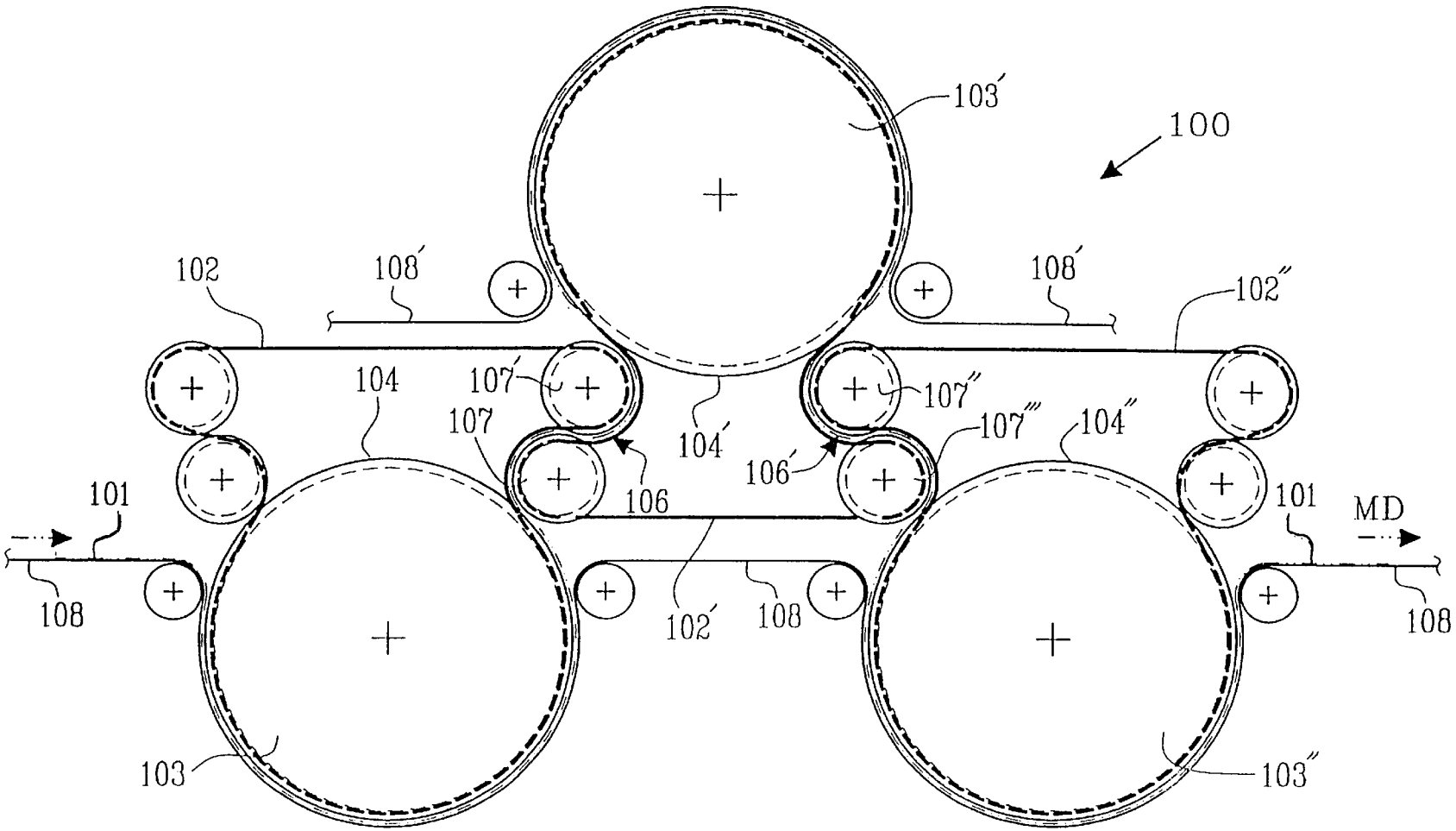
FIG. 2 is a schematic side view of a two-tier drying section in accordance with one embodiment of the invention.

In another embodiment of a drying section according to the invention, as illustrated in FIGS. 2 and 3, the circumference 104' is defined by an outer envelope surface 109' of one of the drying cylinders 103'. In such an embodiment, the outer envelope surface 109' is provided with a groove 110' adapted to house a longitudinal portion of one of the belt members 102'.

In still a further embodiment of a drying section according to the invention, as illustrated by FIG. 4 counter elements include one or more rotatable, belt-guiding members 107'" over and/or between which said belt members run. In such an instance, the rotatable, belt-guiding members 107'" are constituted by axially short rolls, wheels or pulleys, which are provided, in the circumferential surfaces thereof, with one or more grooves 111" for housing longitudinal portions of one or more of the belt members 102". Note that it will be appreciated by one skilled in the art that the belt-guiding members 107'" may take many different forms consistent with the spirit and scope of the present invention. For example, belt-guiding members 107'" may comprise a V-belt pulley having a shallow groove for the belt member such that only the belt member engages the paper web, or a camber-faced pulley configured to correspond to a flat belt.

In an alternative embodiment of a drying section according to the invention (not illustrated) the above-mentioned rotatable, belt-guiding members comprise chain wheels, wherein the belt members comprise corresponding chain belts.

In one embodiment of a drying section according to the invention, the drying cylinders are arranged in one single row in at least one drying unit 300; 400; 600; 600' of the drying section so as to form a single-tier dryer. Such embodiments are illustrated in FIGS. 6–8 and 10–11.

Figure 9:
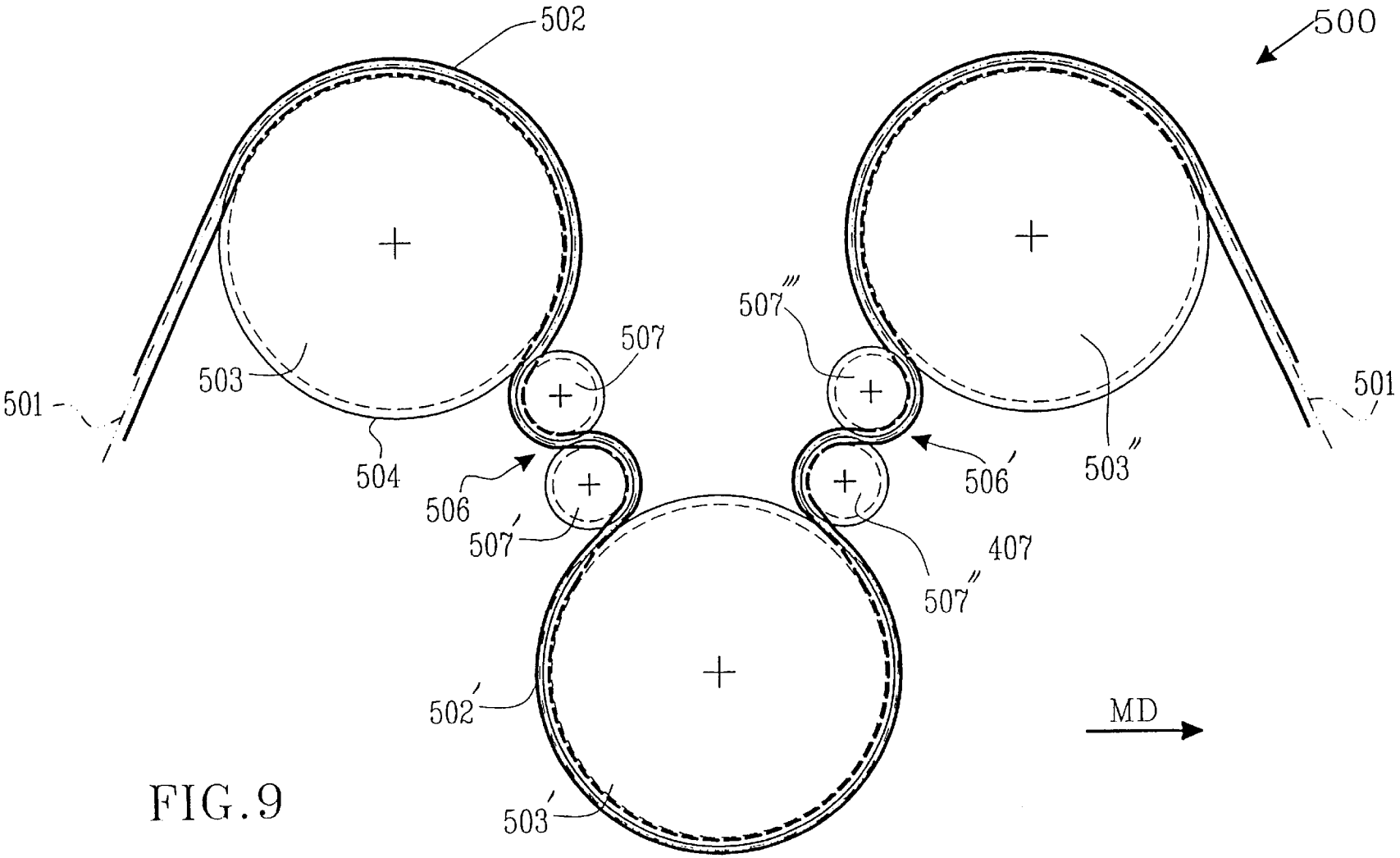
FIG. 9 is a schematic side view of a two-tier drying section in accordance with an alternative embodiment of the invention.

In another embodiment of the invention, the drying cylinders are arranged in two rows in at least one drying unit 100; 200; 500 of the drying section so as to form a two-tier dryer. Such embodiments are illustrated in FIGS. 2,5 and 9.

The above-mentioned belt members are preferably comprised of a rigid material with a rough surface which, in the intermediate zone, faces the fibrous web. In advantageous instances, the belt members may have a cross-section shaped as a rectangle, a parallel trapezoid, or other quadrilateral, as shown in FIG. 3. The belt members may comprise, for example, a strip of a paper machine fabric, a V-belt, a steel belt, or a plastic strip. It will also be understood by one skilled in the art that the belt members may have many different forms and dimensions as required for the particular machine configuration and/or the product to be formed thereby consistent with the spirit and scope of the present invention. For example, the belt members may be relatively narrow, such as, for instance, on the order of about 20 mm wide, and thin, such as, for instance, on the order of about 0.5 mm thick, though such dimensions do not constrain the myriad of other possible configurations.

Figure 5:
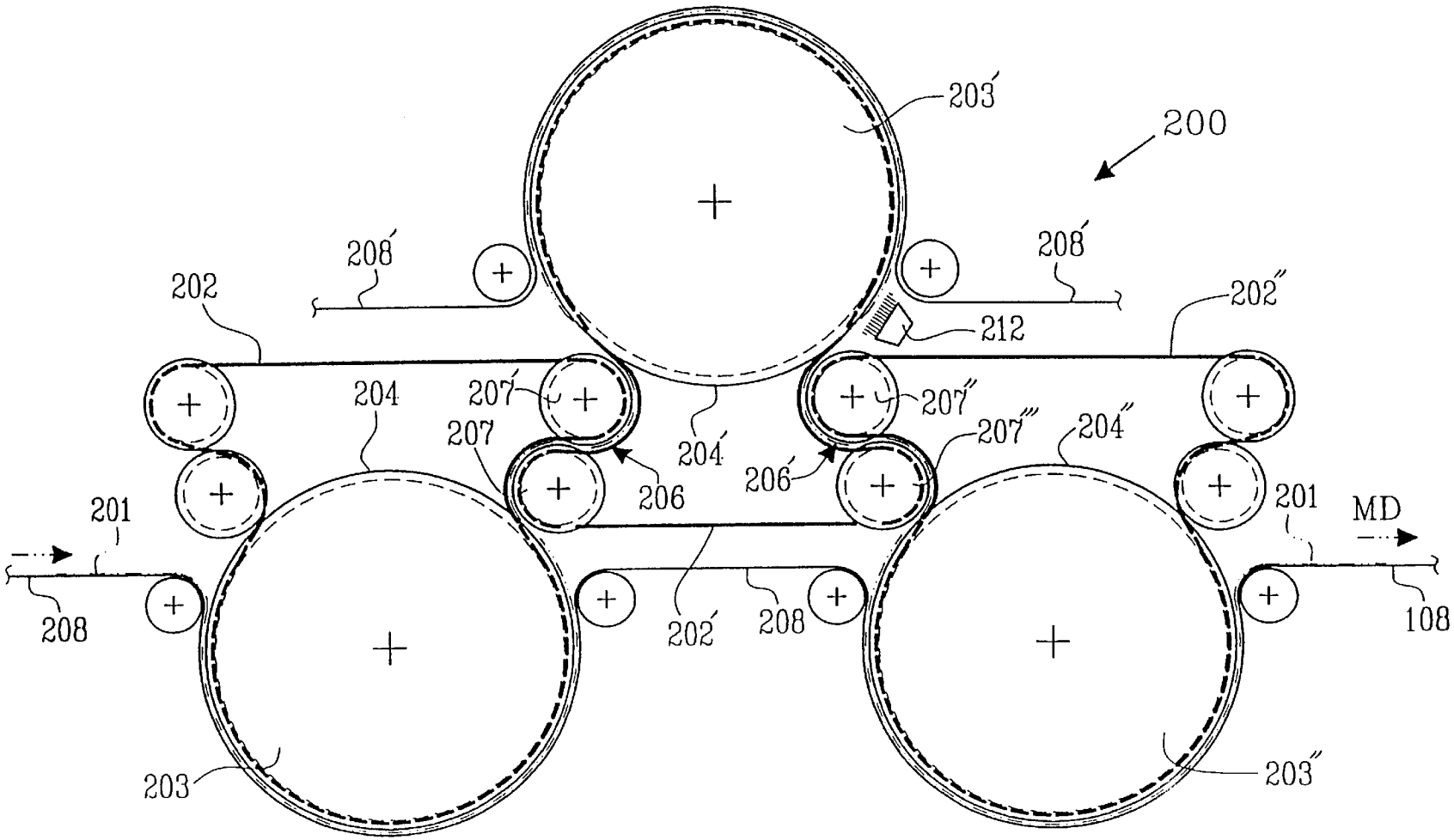
FIG. 5 is a schematic side view of a two-tier drying section in accordance with an alternative embodiment of the invention.
Figure 6:
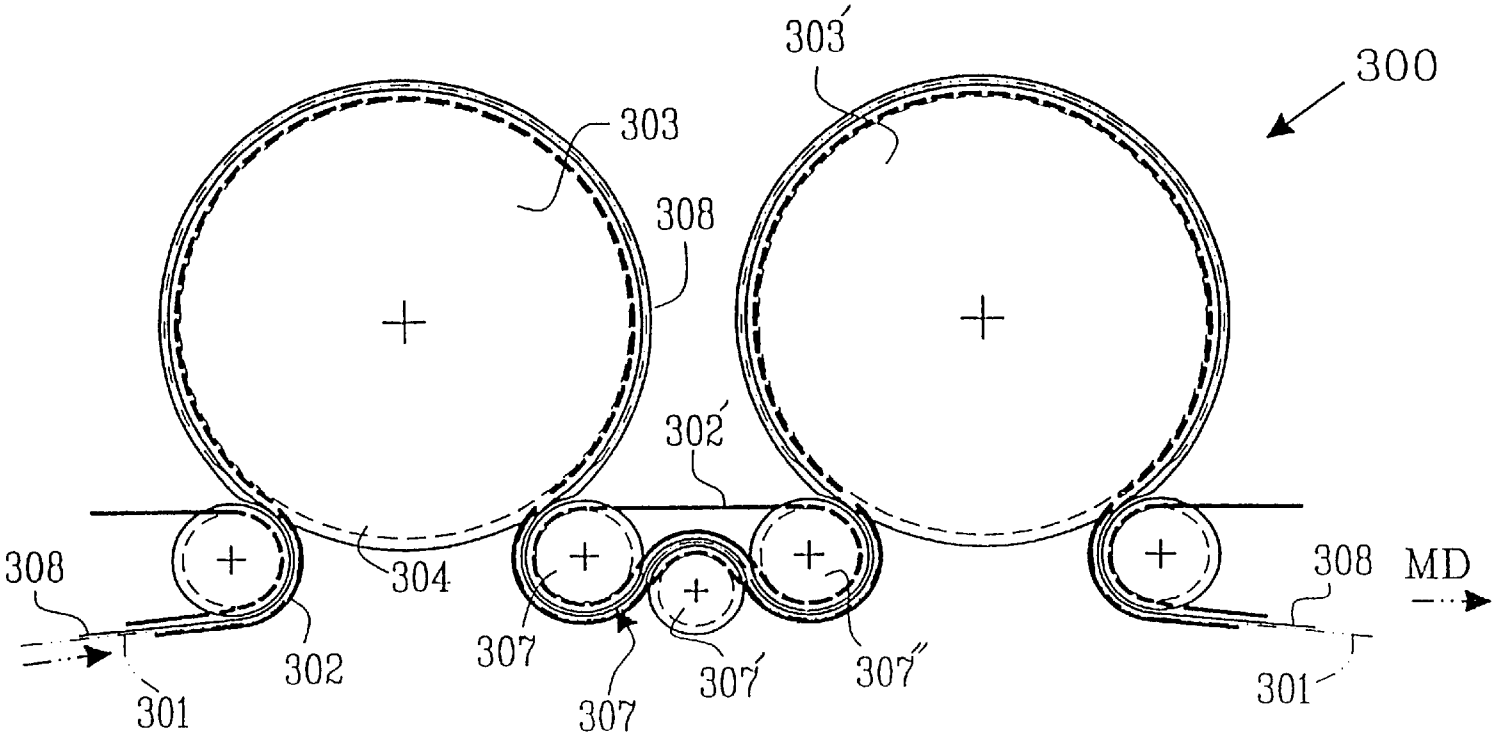
FIG. 6 is a schematic side view of a single-tier drying section in accordance with one embodiment of the invention.

In one further embodiment of a drying section according to the invention, as illustrated in FIG. 5 at least one heating device 212 is arranged for heating the fibrous web 201, specifically at a position and over a width in the transverse direction corresponding to the intermediate zone or zones 206, 206' and/or for heating one or more of the belt members.

Embodiments of the present invention thus permit controlled shrinkage/stretching of a paper or paperboard web through the drying section of a paper making machine, in both the machine direction as well as in the transverse direction. This control can be utilized, e.g. for obtaining a higher and more even quality of the final paper or the finished paperboard after drying, for controlling the physical properties of the paper or the paperboard, or for an improved runnability. Further the present invention may also be advantageously used for "tail threading" in connection with the start-up of a paper or paperboard-making machine, for instance, after a web break or after a shut down. The securing of the web by the belt members, in cooperation with support counter elements, the main counter elements, and possibly drying cylinders and machine clothings, enables the machine to be started with a full web width of the paper or paperboard web instead of the less advantageous conventional tail threading, wherein only a narrow strip of the web is conducted through the drying section, with the assistance of manual handling by an attendant, before full web width drying can be resumed.

When performing embodiments of the present invention, it will be understood that all free draws that otherwise occur in the drying section, according to prior art, are minimized. In certain cases it might, however, for space or maintenance reasons, be necessary to permit a short distance where the paper or paperboard web is supported but not secured, such as, for instance, corresponding to the position of the heating device 212 as shown in FIG. 5.

Figure 10:
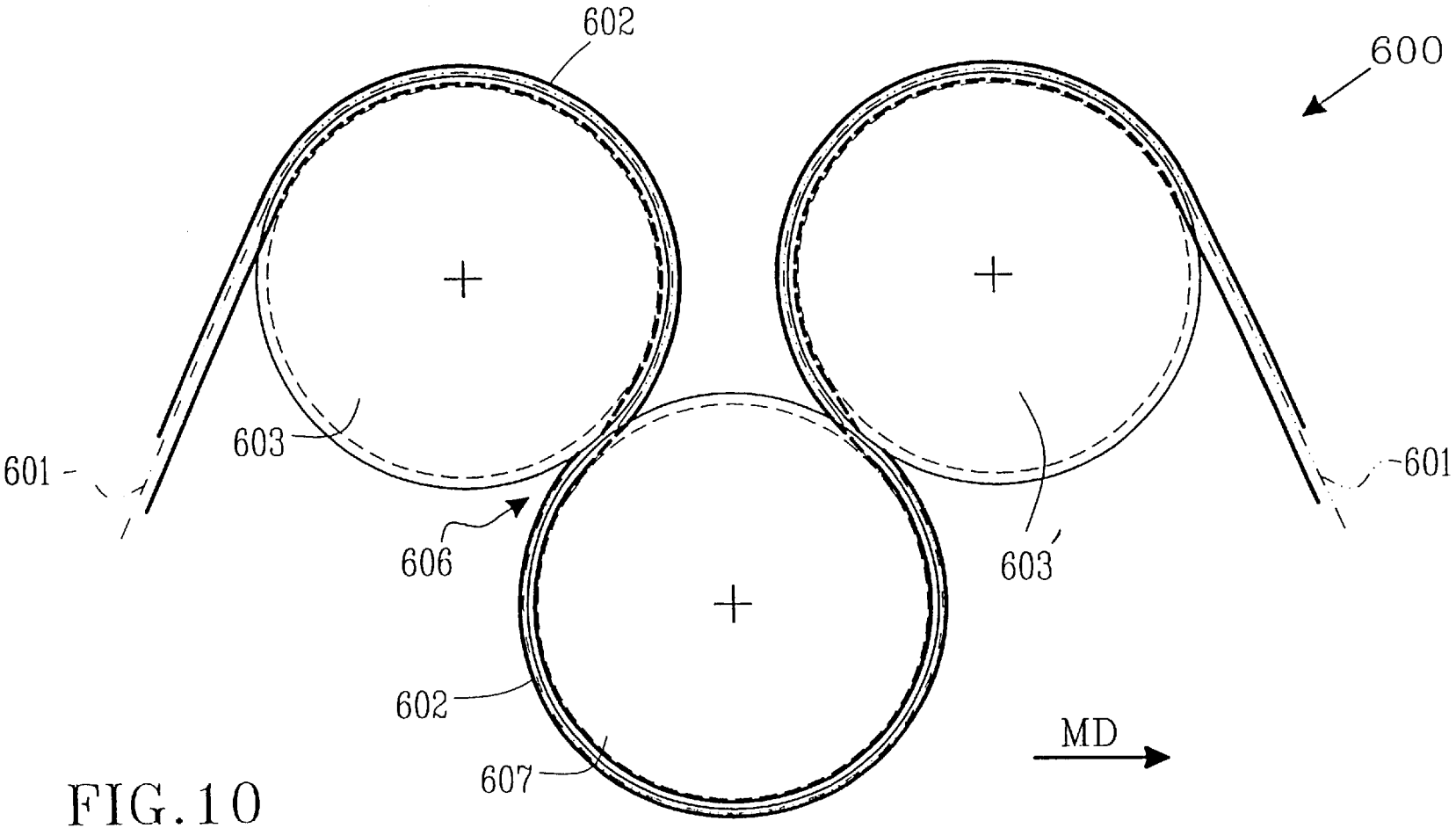
FIG. 10 is a schematic side view of a single-tier drying section in accordance with an alternative embodiment of the invention.
Figure 11:
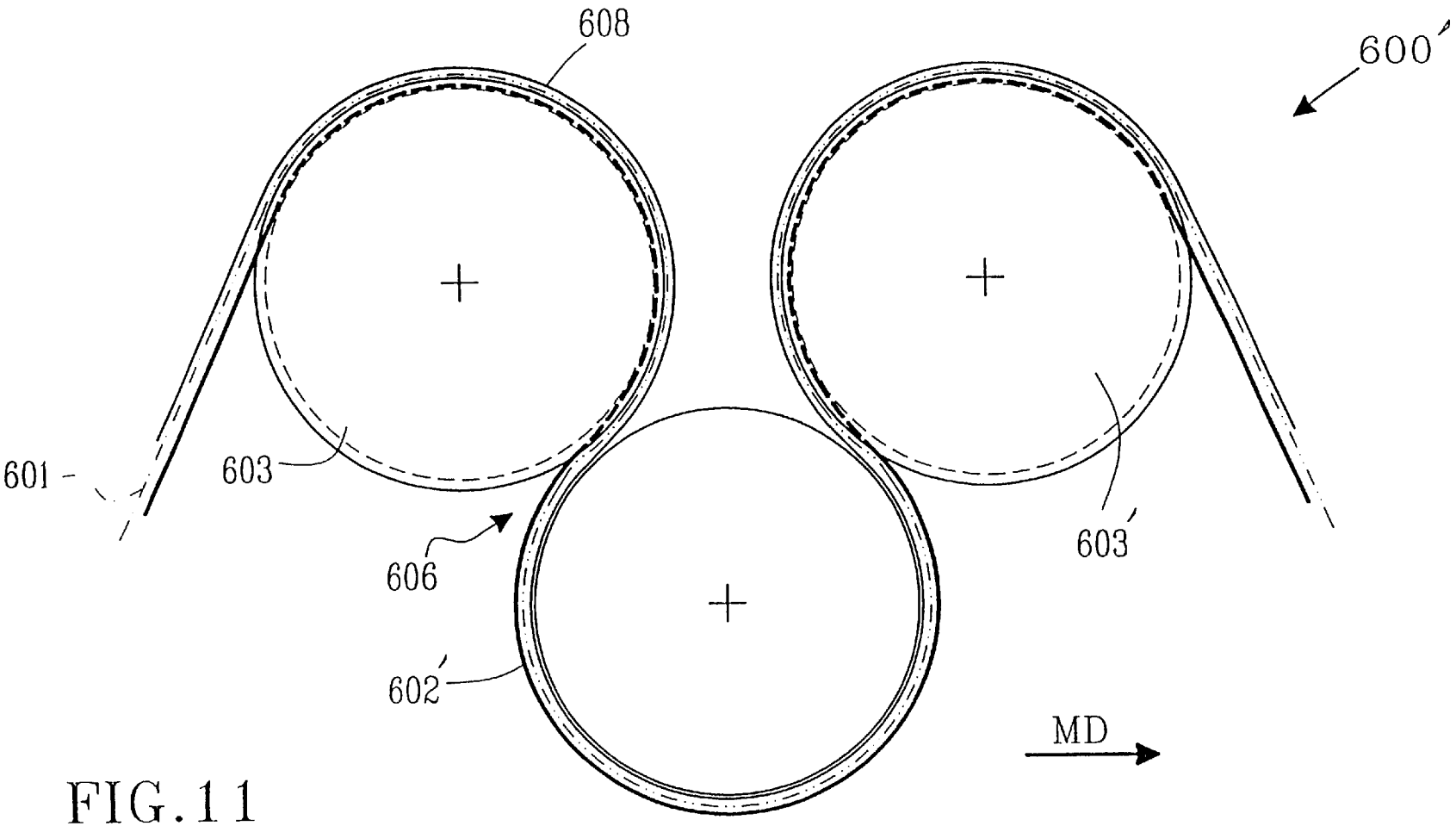
FIG. 11 is a schematic side view of the drying section shown in FIG. 10 in accordance with one embodiment of the invention.

As has been shown by the above description, many different embodiments are within the scope of the present invention. FIG. 11 thus shows an alternative embodiment 600' of a drying unit 600 as shown in FIG. 10. In the embodiment 600' shown in FIG. 11, a drying fabric 608, which firmly secures the width of the web 601 during passage over the drying cylinders 603, 603', is substituted for the belt members 602, which, as shown in FIG. 10, secure the edges of the web during passage over the drying cylinders 603, 603', whereas the remaining belt members 602' secure the edges of the web 601 during passage through the intermediate zone 606.

Many modifications and other embodiments of the invention will come to mind to one skilled in the art to which this invention pertains having the benefit of the teachings presented in the foregoing descriptions and the associated drawings. For example, a fiber web produced according to a method such as described herein would exhibit increased stiffness due to the shrinkage control experienced during the drying process. Thus, the stiffness of paper or paperboard may be controlled so as to produce intermediate products such as paper sheets or paperboard blanks, or final products such as a paperboard box, having desirable stiffness characteristics corresponding to the particular application. In addition, many other paper grades such as copying paper, newsprint, and journal paper may be made stiffer. Consequently, for example, less papermaking fibers may be required in order to produce the respective paper grades having the same stiffness than in corresponding paper grades produced according to a process where shrinkage is not controlled. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A drying section for drying and controlling shrinkage of a moist fiber web, the web having a predetermined width and opposed transverse ends, in a paper making machine, said drying section comprising:

a plurality of drying section members configured to receive and forward the web in a machine direction, each drying section member having opposed ends in a transverse direction, the drying section members further comprising a first drying section member and a second drying section member, with the second drying section member being separated from the first drying section member so as to define an intermediate zone therebetween;

a primary belt set comprising a belt member wrapping about each of the opposed ends of each of the drying section members, each belt member being configured in an endless loop and having a width less than half of the width of the web; and a first web-supporting element opposing the primary belt set such that the web is disposed therebetween, the web being continuously supported between the first web-supporting element and the primary belt set, without free draw, at least substantially through the intermediate zone, the fist web-supporting element being further configured with respect to the primary belt set so as to transport the web through the intermediate zone in a curved path, the first web-supporting element further cooperating with the primary belt set so as to at least partially constrain the web about the opposed transverse ends thereof to thereby control at least transverse shrinkage of the web.

2. A drying section according to claim 1 wherein the first web-supporting element is selected from the group consisting of a drying fabric, a bolt set, one of the drying section members, a counter element, and combinations thereof.

3. A drying section according to claim 1 wherein the primary belt set comprises a first belt set having a first belt member wrapping about each of the opposed ends of at least the first drying section member.

4. A drying section according to claim 3 wherein the fast web-supporting element further comprises a second belt set comprising a second belt member corresponding to and opposing each of the respective first belt members comprising the first belt set, at least substantially through the intermediate zone and such that the web is disposed therebetween, each second belt member being configured in an endless loop and having a width less than half of the width of the web.

5. A drying section according to claim 3 wherein the primary belt set further comprises a third belt set having a third belt member wrapping about each of the opposed ends of at least the second drying section member, at least one of the first web-supporting element and the third belt set opposing the first belt set, at least substantially through the intermediate zone, such that the web is disposed therebetween.

6. A drying section according to claim 5 further comprising a second web-supporting element opposing the third belt set, at least substantially about the second drying section member, such that the web is disposed therebetween, the second web-supporting element cooperating with the third belt set so as to at least partially constrain the web in at least the transverse direction.

7. A drying section according to claim 6 wherein the second web-supporting element and the third belt set are configured, with respect to the first web-supporting element and the first belt set, to at least one of maintain the predetermined width of the web, allow at least partial transverse shrinkage of the web, and at least partially transversely stretch the web.

8. A drying section according to claim 6 wherein the web-supporting elements are configured to cooperate with the belt sets so as to at least one of prevent shrinkage of the web in the machine direction, allow at least partial shrinkage of the web in the machine direction, and at least partially stretch the web in the machine direction.

9. A drying section according to claim 6 further comprising a heated-air-emitting device extending across the width of the web and configured to emit hot air to heat at least one of the web, one of the belt sets, and one of the web-supporting elements, the heated-air-emitting device being disposed opposite to one of the drying section members, outside the intermediate zone, such that the web is forwarded therebetween in the machine direction.

10. A drying section according to claim 6 wherein the first web-supporting element comprises at least one counter element disposed in and extending substantially across the intermediate zone, and the at least one counter element has at least one of a drying fabric and one of the belt sets wrapping thereabout.

11. A drying section according to claim 10 wherein at least one of the drying section members and the at least one counter element are configured to have a groove corresponding to and accommodating one of the belt sets wrapping thereabout.

12. A drying section according to claim 10 wherein the at least one counter element comprises a drying cylinder.

13. A drying section according to claim 10 wherein one of the belt sets is arranged to wrap about the at least one counter element so as to have the web disposed therebetween.

14. A drying section according to claim 10 wherein the at least one counter element comprises at least one rotatable cylindrical member.

15. A drying section according to claim 14 wherein at least one of the belt members comprises a chain belt and the corresponding at least one rotatable cylindrical member is configured to be compatible therewith.

16. A drying section according to claim 6 wherein at least one of the belt members is configured so as to have a quadrilaterally-shaped cross-section.

17. A drying section according to claim 6 wherein at least one of the belt members further comprises at least one of a rubber belt, a steel belt, a plastic belt, a paper making machine clothing.

18. A drying section according to claim 1 wherein at least one of the drying section members comprises a drying cylinder.

19. A drying section according to claim 1 wherein the drying cylinders are arranged in a substantially single tier so as to form a single tier drying section.

20. A drying section according to claim 1 wherein the drying cylinders are arranged in more than a single tier so as to form a multi-tier drying section.

21. A method of drying and controlling shrinkage of a moist fiber web, the web having a predetermined width and opposed transverse ends, in a drying section of a paper making machine, said method comprising:

forwarding the web about a plurality of drying section members configured to receive and forward the web in a machine direction, each drying section member having opposed ends in a transverse direction, the drying section members further comprising a first drying section member and a second drying section member, with the second drying section member being separated from the first drying section member so as to define an intermediate zone therebetween; and at least partially constraining the web in at least the transverse direction with a first belt set disposed opposite to the web from a web-supporting element, both the first belt set and the web-supporting element operably engaging the web so as to continuously support the web therebetween, without free draw, at least substantially through the intermediate zone, the first belt set comprising a first belt member wrapping about each of the opposed ends of each of the drying section members, each first belt member being configured in an endless loop and having a width less than half of the width of the web, the first belt set cooperating with the web-supporting element to transport the web through the intermediate zone in a curved path and to at least partially constrain the web about the opposed transverse ends thereof so as to control shrinkage of the web.

22. A method according to claim 21 wherein at least one of the drying section members comprises a drying cylinder and the method further comprises forwarding the web about the drying cylinder so as to dry the web.

23. A method according to claim 21 wherein at least partially constraining the web further comprises at least partially constraining the web by configuring the first belt set and the web-supporting element to operably engaging the web so to at least one of maintain the predetermined width of the web, allow at least partial transverse shrinkage of the web, and at least partially transversely stretch the web as the web is forwarded about the drying section members.

24. A method according to claim 21 wherein at least partially constraining the web further comprises at least partially constraining the web by configuring the first belt set and the web-supporting element to operably engaging the web so as to at least one of prevent shrinkage of the web in the machine direction, allow at least partial shrinkage of the web in the machine direction, and at least partially stretch the web in the machine direction as the web is forwarded about the drying section members.

25. A method according to claim 21 further comprising heating at least one of the web, the first belt set, and the web-supporting element with a heated-air-emitting device extending across the width of the web and configured to emit hot air, the heated-air-emitting device being disposed opposite to one of the drying section members, outside the intermediate zone, such that the web is forwarded therebetween in the machine direction.

26. A method according to claim 21 further comprising forwarding the web about a web-supporting element comprising at least one counter element disposed in and extending substantially across the intermediate zone, the at least one counter element having at least one of the first belt set, another belt set, and a drying fabric wrapping thereabout such that the web travels therebetween through the intermediate zone.

27. A method according to claim 26 wherein the web-supporting element further comprises a second belt set comprising a second belt member corresponding to and opposing each of the respective first belt members comprising the first belt set and the method further comprises forwarding the web about at least one counter element disposed in and extending substantially across the intermediate zone such that the web travels through the intermediate zone between the at least one counter element and at least one of the first belt set and the second belt set.

28. A fiber web having a predetermined width and opposed transverse ends and produced according to a method of drying and controlling shrinkage of a moist fiber web in a drying section of a paper making machine, said method comprising:

forwarding the web about a plurality of drying section members configured to receive and forward the web in a machine direction, each drying section member having opposed ends in a transverse direction, the drying section members further comprising a first drying section member and a second drying section member, with the second drying section member being separated from the first drying section member so as to define an intermediate zone therebetween; and at least partially constraining the web in at least the transverse direction with a first belt set disposed opposite to the web from a web-supporting element, with both the first belt set and the web-supporting element operably engaging the web so as to continuously support the web therebetween, without free draw, at least substantially through the intermediate zone, the first belt set comprising a first belt member wrapping about each of the opposed ends of each of the drying section members, each fist belt member being configured in an endless loop and having a width less than half of the width of the web, the fist belt set cooperating with the web-contacting element to transport the web through the intermediate zone in a curved path and to at least partially constrain the web about the opposed transverse ends thereof so as to control shrinkage of the web.

29. A fiber web produced by a method of drying and controlling shrinkage of a moist fiber web according to claim 28 wherein at least one of the drying section members comprises a drying cylinder and the method further comprises forwarding the web about the drying cylinder so as to dry the web.

30. A fiber web produced by a method of drying and controlling shrinkage of a moist fiber web according to claim 28 wherein at least partially constraining the web further comprises at least partially constraining the web by configuring the first belt set and the web-supporting element to operably engaging the web so to at least one of maintain the predetermined width of the web, allow at least partial transverse shrinkage of the web, and at least partially transversely stretch the web as the web is forwarded about the drying section members.

31. A fiber web produced by a method of drying and controlling shrinkage of a moist fiber web according to claim 28 wherein at least partially constraining the web further comprises at least partially constraining the web by configuring the first belt set and the web-supporting element to operably engaging the web so as to at least one of prevent shrinkage of the web in the machine direction, allow at least partial shrinkage of the web in the machine direction, and at least partially stretch the web in the machine direction as the web is forwarded about the drying section members.

32. A fiber web produced by a method of drying and controlling shrinkage of a moist fiber web according to claim 28 further comprising heating at least one of the web, the first belt set, and the web-supporting element with a heated-air-emitting device extending across the width of the web and configured to emit hot air, the heated-air-emitting device being disposed opposite to one of the drying section members, outside the intermediate zone, such that the web is forwarded therebetween in the machine direction.

33. A fiber web produced by a method of drying and controlling shrinkage of a moist fiber web according to claim 28 further comprising forwarding the web about a web-supporting element comprising at least one counter element disposed in and extending substantially across the intermediate zone, the at least one counter element having at least one of the first belt set, another belt set, and a drying fabric wrapping thereabout such that the web travels therebetween through the intermediate zone.

34. A fiber web produced by a method of drying and controlling shrinkage of a moist fiber web according to claim 33 wherein the web-supporting element further comprises a second belt set comprising a second belt member corresponding to and opposing each of the respective first belt members comprising the first belt set and the method further comprises forwarding the web about at least one counter element disposed in and extending substantially across the intermediate zone such that the web travels through the intermediate zone between the at least one counter element and at least one of the first belt set and the second belt set.

* * * * *

UNITED STATES PATENT AND TRADEMARK OFFICE

CERTIFICATE OF CORRECTION

PATENT NO. : 6,490,811 B1
DATED : December 10, 2002
INVENTOR(S) : Wahlström

It is certified that error appears in the above-identified patent and that said Letters Patent is hereby corrected as shown below:

Column 11,
Line 60, “fist” should read -- first --.

Column 12,
Line 3, “bolt” should read -- belt --;
Line 9, “fast” should read -- first --.

Column 14,
Lines 55 and 57, “fist” should read -- first --.

Signed and Sealed this

Twenty-fifth Day of March, 2003

JAMES E. ROGAN
*Director of the United States Patent and Trademark Office*